US009790447B2

(12) United States Patent
Mori et al.

(10) Patent No.: US 9,790,447 B2
(45) Date of Patent: Oct. 17, 2017

(54) SLIDING SYSTEM

(71) Applicant: TOYOTA JIDOSHA KABUSHIKI KAISHA, Toyota-shi, Aichi-ken (JP)

(72) Inventors: Hiroyuki Mori, Nagakute (JP); Mamoru Tohyama, Nagakute (JP); Masaru Okuyama, Nagakute (JP); Keiji Hayashi, Nagoya (JP); Naoya Ikeda, Toyota (JP)

(73) Assignee: TOYOTA JIDOSHA KABUSHIKI KAISHA, Toyota-shi, Aichi-ken (JP)

( * ) Notice: Subject to any disclaimer, the term of this patent is extended or adjusted under 35 U.S.C. 154(b) by 11 days.

(21) Appl. No.: 14/796,081

(22) Filed: Jul. 10, 2015

(65) Prior Publication Data

US 2016/0115414 A1 Apr. 28, 2016

(30) Foreign Application Priority Data

Oct. 24, 2014 (JP) ..... 2014-217557

(51) Int. Cl.

| | |
|---|---|
| ***C10M 103/04*** | (2006.01) |
| ***C10M 103/06*** | (2006.01) |
| ***C10M 125/22*** | (2006.01) |
| ***C10M 113/08*** | (2006.01) |

(52) U.S. Cl.

CPC ..... *C10M 103/04* (2013.01); *C10M 103/06* (2013.01); *C10M 113/08* (2013.01); *C10M 2201/066* (2013.01); *C10N 2210/06* (2013.01); *C10N 2230/06* (2013.01); *C10N 2230/42* (2013.01); *C10N 2230/43* (2013.01); *C10N 2240/10* (2013.01); *C10N 2280/00* (2013.01)

(58) Field of Classification Search

CPC ..... C10M 103/04; C10M 103/06; C10M 113/08; C10M 2201/066; C10N 2210/06; C10N 2230/06; C10N 2230/42; C10N 2230/43; C10N 2240/10; C10N 2280/00

See application file for complete search history.

(56) References Cited

U.S. PATENT DOCUMENTS

| | | | | |
|---|---|---|---|---|
| 7,879,777 | B2 | 2/2011 | Tynik et al. | |
| 2004/0121919 | A1* | 6/2004 | Gao | C10M 123/04 508/363 |
| 2005/0119136 | A1 | 6/2005 | Castle | |
| 2006/0269790 | A1* | 11/2006 | Sarabanda | C23C 14/025 428/698 |
| 2007/0203033 | A1 | 8/2007 | Tynik et al. | |
| 2008/0095939 | A1* | 4/2008 | Fischer | C23C 14/0641 427/255.394 |
| 2013/0129264 | A1 | 5/2013 | Watanabe et al. | |

FOREIGN PATENT DOCUMENTS

| | | | |
|---|---|---|---|
| CN | 103635602 | A | 3/2014 |
| DE | 69707714 | T2 | 4/2002 |
| EP | 1661971 | A1 | 5/2006 |
| EP | 1963721 | B1 | 8/2009 |
| JP | 2001-335878 | A | 12/2001 |
| JP | 2002-508384 | A | 3/2002 |
| JP | 2004-339486 | A | 12/2004 |
| JP | 3728740 | B2 | 10/2005 |
| JP | 2008-505251 | A | 2/2008 |
| JP | 2009-521593 | A | 6/2009 |
| JP | 2010-168603 | A | 8/2010 |
| JP | 2011-252073 | A | 12/2011 |
| WO | 2012/116818 | A1 | 9/2012 |

OTHER PUBLICATIONS

Communication dated Jun. 23, 2016 from the German Patent and Trademark Office in counterpart application No. 102015113547.7.
Communication dated Aug. 23, 2016 from the Japanese Patent Office in counterpart Application No. 2014-217557.
Communication dated Mar. 28, 2017, from the Chinese Patent Office in counterpart Application No. 201510695250.6, 9 pages.

* cited by examiner

*Primary Examiner* — James Goloboy
(74) *Attorney, Agent, or Firm* — Sughrue Mion, PLLC

(57) ABSTRACT

[Technical Problem]
An object is to provide a sliding system which can drastically reduce the friction coefficient on a sliding portion by means of a novel combination of a chromium nitride film and a lubricant oil.
[Solution to Problem]
The sliding system according to the present invention includes: a pair of sliding members having sliding surfaces that can relatively move while facing each other; and a lubricant oil that can be interposed between the sliding surfaces facing each other. At least one of the sliding surfaces is formed as a coating surface of a chromium nitride film, and the lubricant oil contains an oil-soluble molybdenum compound that has a chemical structure of a trinuclear of Mo. When the chromium nitride film as a whole is 100 at % (referred simply to as "%"), the chromium nitride film contains 40-65% of Cr and 35-55% of N, and the chromium nitride film has a relative surface area of 15-60% wherein the relative surface area is a surface area ratio of (111) plane to (200) plane obtained when analyzed using X-ray diffraction. The lubricant oil preferably contains 5-800 ppm of the oil-soluble molybdenum compound in a content mass of Mo to the lubricant oil as a whole.

11 Claims, 5 Drawing Sheets

R = hydrocarbyl

Mo−Trinuclear

SLIDING SYSTEM

TECHNICAL FIELD

The present invention relates to a sliding system which can drastically reduce the friction coefficient and sliding resistance, etc., acting between sliding surfaces, by means of a combination of a chromium nitride film and a lubricant oil that contains an oil-soluble molybdenum compound having a specific chemical structure.

BACKGROUND ART

Various machines are provided with sliding members that relatively move while being slidably in contact with each other. In a system having such sliding members (referred to as a "sliding system" in the present description, e.g., a sliding machine), the resistance force (sliding resistance) acting on the sliding portions may be reduced thereby to enhance the performance and reduce the energy necessary for operation. Such reduction of sliding resistance is ordinarily achieved by reducing the friction coefficient acting between sliding surfaces.

Friction coefficient acting between sliding surfaces differs depending on the surface condition of each sliding surface and the lubrication state between the sliding surfaces. To reduce the friction coefficient, therefore, it may be contemplated to modify the sliding surfaces and improve the lubricant (lubricant oil) which is supplied between the sliding surfaces. Various types of surface modification for sliding surfaces are known, among which modification has often been performed such that the sliding surfaces are each formed with an amorphous carbon film (so-called diamond-like carbon (DLC) film) that can reduce the friction and has excellent wear resistance. The lubricant is also improved in various manners in accordance with the type of sliding machine, the environment of usage, and other factors, but in many cases the improvement may be achieved by compounding an additive that has an effect of reducing the friction. Descriptions relevant to the above are found in Patent Literature (PTL) below, for example.

CITATION LIST

Patent Literature

[PTL 1]
JP2011-252073A
[PTL 2]
JP2004-339486A (EP1462508B 1)
[PTL 3]
U.S. Pat. No. 3,728,740 (JP8-296030A)

SUMMARY OF INVENTION

Technical Problem

PTL 1 proposes combining a lubricant with an H (20%)-containing DLC film, wherein the lubricant contains an organic molybdenum compound having a mass ratio of nitrogen and molybdenum (N/Mo) within a predetermined range as substitute for molybdenum dithiocarbamate (MoDTC) comprising a binuclear of Mo which is a well-known additive for engine oil.

PTL 2 proposes a combination of an ordinary DLC film and a lubricant, wherein the DLC film is free from metal elements and other additive elements, and the lubricant is obtained by adding 550 ppm, as an amount of Mo, of molybdenum dithiocarbamate to a base oil. PTL 2, however, merely describes that the combination can reduce the friction coefficient, and nothing in PTL 2 reveals the mechanism and the like. Moreover, the friction coefficient obtained by the combination is about 0.1 at the most, and the reduction of the friction coefficient may thus be insufficient.

PTL 3 describes providing an outer circumferential sliding surface of a piston ring for internal-combustion engines with an ion plating film of a mixture of CrN-type chromium nitride and $Cr_2N$-type chromium nitride, wherein the crystal orientation ratio of the CrN and the $Cr_2N$ is optimized thereby to improve the wear resistance, the anti-scuffing ability and other properties of piston rings. However, PTL 3 merely describes performing wear resistance test and other tests using an ordinary engine oil as the lubricant, and nothing in PTL 3 describes or suggests the influence, etc., that the above film affects the friction coefficient between the sliding surfaces.

The present invention has been created in view of such circumstances, and an object of the present invention is to provide a sliding system which can drastically reduce at least the friction coefficient between sliding surfaces compared with that in the prior art, by means of a novel combination of a sliding film and a lubricant oil.

Solution to Problem

As a result of intensive studies to achieve the above object and repeating trial and error, the present inventors have discovered that a novel combination of a specific chromium nitride film and a lubricant oil that contains an oil-soluble molybdenum compound having a specific chemical structure can drastically reduce the friction coefficient between sliding surfaces. Moreover, it has also been found that such an excellent low-friction property can be satisfied concurrently with the wear resistance. Developing this achievement, the present inventors have accomplished the present invention as will be described hereinafter.

<<Sliding System>>

(1) The sliding system of the present invention comprises: a pair of sliding members having sliding surfaces that can relatively move while facing each other; and a lubricant oil that can be interposed between the sliding surfaces facing each other. The sliding system has features as below. At least one of the sliding surfaces comprises a coating surface of a chromium nitride film. The lubricant oil contains an oil-soluble molybdenum compound that has a chemical structure of a trinuclear of molybdenum (Mo). When the chromium nitride film as a whole is 100 at % (referred simply to as "%"), the chromium nitride film contains 40-65% of chromium (Cr) and 35-55% of nitrogen (N). The chromium nitride film has a relative surface area of 15-60%. The relative surface area is a surface area ratio of (111) plane to (200) plane obtained when analyzed using X-ray diffraction.

(2) The sliding surface coated with a specific chromium nitride film, and the lubricant oil which contains an oil-soluble molybdenum compound having a specific chemical structure, are combined thereby to allow a sliding system to be obtained which can drastically reduce the friction coefficient between sliding surfaces. Specifically, a low-friction property can be developed such that the friction coefficient is 0.07 or less in an embodiment, 0.06 or less in another embodiment, and 0.05 or less in a further embodiment. Consequently, according to the sliding system of the present invention, the sliding resistance and the friction loss can be drastically reduced to allow considerable improvement such as in the motion performance of various machines and energy conservation.

Moreover, the chromium nitride film according to the present invention can exhibit excellent wear resistance in addition to the low-friction property. For example, the sliding surface of a chromium nitride film can have a friction depth, which is indicative of the wear resistance, of ¼ or less in an embodiment, and ⅕ or less in another embodiment, compared with that of a sliding surface formed only of a steel material. Therefore, the sliding system of the present invention is particularly suitable for machines, such as in a drive system, which are operated for a long time under severe conditions from a boundary lubrication (friction) condition to a mixed lubrication (friction) condition. The present invention can thus contribute to reduction of fuel consumption and other benefits when used for a drive system unit, such as engine and transmission, for example.

(3) Although the mechanism is not necessarily sure that the combination of a specific chromium nitride film and a specific lubricant according to the present invention develops an excellent low-friction property and other advantageous properties, the present inventors consider under present circumstances as follows after intensive studies.

When the sliding system (specifically a sliding machine) of the present invention is operated, an adsorption reaction of the oil-soluble molybdenum compound, which is contained in the lubricant oil and comprises a trinuclear of Mo (and which may be referred to as a "Mo-trinuclear compound" or simply as a "Mo-trinuclear"), is promoted on the sliding surface of the chromium nitride film. This allows the sliding surface to readily adsorb other additives or constituent elements thereof (such as Mo and S) which are in a competitive adsorption relationship with the Mo-trinuclear. This appears to result in adsorption of a relatively large amount (large thickness) of a molybdenum sulfide compound of a $MoS_2$ structure, other than the Mo-trinuclear, to the coating surface (sliding surface) of the chromium nitride film. It is known that the molybdenum sulfide compound of the $MoS_2$ structure has a lamellar structure and exhibits a low shear property. This appears to allow the friction coefficient to be drastically reduced on the sliding surface of the chromium nitride film even under a wide variety of operational situations including the boundary friction.

It is thus preferred that, when the sliding system of the present invention is operated, Mo and S are present on the sliding surface of the chromium nitride film, and a ratio of the number of atoms of S to that of Mo is 2 or more in an embodiment, 4 or more in another embodiment, and 5 or more in a further embodiment, when analyzed using X-ray photoelectron spectroscopy (XPS). It is also preferred that, when a detected amount by the XPS is 100 at % as a whole, the detected amount of Mo is 0.04 at % or more in an embodiment, and 0.06 at % or more in another embodiment.

The chromium nitride film according to the present invention is ordinarily harder than a base material (e.g., steel material) of the sliding member and unlikely to transfer and adhere to the sliding surface of the counterpart sliding member. Accordingly, the sliding system of the present invention exhibits high wear resistance in the presence of the above-described lubricant oil, and an excellent low-friction property can be stably obtained for a long period of time.

(4) The Mo-trinuclear according to the present invention is not limited in its functional groups bonded to the ends, molecular weight and other properties as long as the Mo-trinuclear has a molecular structural skeleton of at least one of $Mo_3S_7$ or $Mo_3S_8$ (in particular $Mo_3S_7$). Just for reference, FIG. 6 illustrates an example of the molybdenum sulfide compound of $Mo_3S_7$. In the figure, R represents a hydrocarbyl group.

The Mo-trinuclear according to the present invention can react to adsorb to the sliding surface, thereby forming a molybdenum sulfide compound having a chemical structure, such as $Mo_3S_7$, $Mo_3S_8$ and $Mo_2S_6$, on the sliding surface. Such a molybdenum sulfide compound also has a similar structure to that of molybdenum disulfide ($MoS_2$), and can exhibit a low shear property between the sliding surfaces based on the lamellar structure to contribute to the reduction of the friction coefficient.

(5) The chromium nitride film according to the present invention primarily comprises Cr and N, but may further contain, as additional elements, doped elements (e.g., 0) and other elements which do not inhibit the low-friction property or which improve the low-friction property. Cr and N in the chromium nitride film exist mainly as CrN, but a part thereof may be $Cr_2N$ (dichromium nitride) or in other appropriate form. In consideration of the above, it is preferred that, when the chromium nitride film as a whole is 100 at % (referred simply to as "%"), the chromium nitride film according to the present invention contains 40-65% of Cr and 35-55% of N in an embodiment, and 45-62% of Cr and 38-50% of N in another embodiment. When the chromium nitride film contains doped elements such as O, it is preferred that the chromium nitride film contains 2-15% of O in an embodiment, and 7-13% of O in another embodiment, for example. Such a film composition may be specified using an electron probe microanalyzer (EPMA).

The chromium nitride film according to the present invention may readily develop a low-friction property when having a specific crystal structure. To this end, it is preferred that the chromium nitride film according to the present invention has a relative surface area of 15-60% in an embodiment, and 20-45% in another embodiment, wherein the relative surface area is a surface area ratio of (111) plane to (200) plane. The surface area ratio (relative surface areas) of planes may be calculated by image analysis based on profiles obtained using X-ray diffraction.

<<Others>>

(1) The "sliding system" as referred to in the present invention is sufficient as long as it comprises sliding members and lubricant oil, and may not only be a completed product as a machine but may also be a combination of mechanical elements that constitute a part of the product, etc. The sliding system of the present invention may also be referred to as a sliding structure, a sliding machine (e.g., engine, transmission), or other appropriate term.

The coating surface of the chromium nitride film according to the present invention may be formed as a sliding surface of at least one of the sliding members which relatively move while facing each other. As will be understood, it is more preferred that both of the sliding surfaces facing each other are the coating surfaces of the chromium nitride films.

(2) Unless otherwise stated, a numerical range "x to y" as referred to herein includes the lower limit value x and the upper limit value y. Various numerical values or any numerical value included in numerical ranges described herein may be appropriately selected or extracted as a new lower limit value or upper limit value, and any numerical range such as "a to b" may thereby be newly provided using such a new lower limit value or upper limit value.

DESCRIPTION OF EMBODIMENTS

Figure 1A:
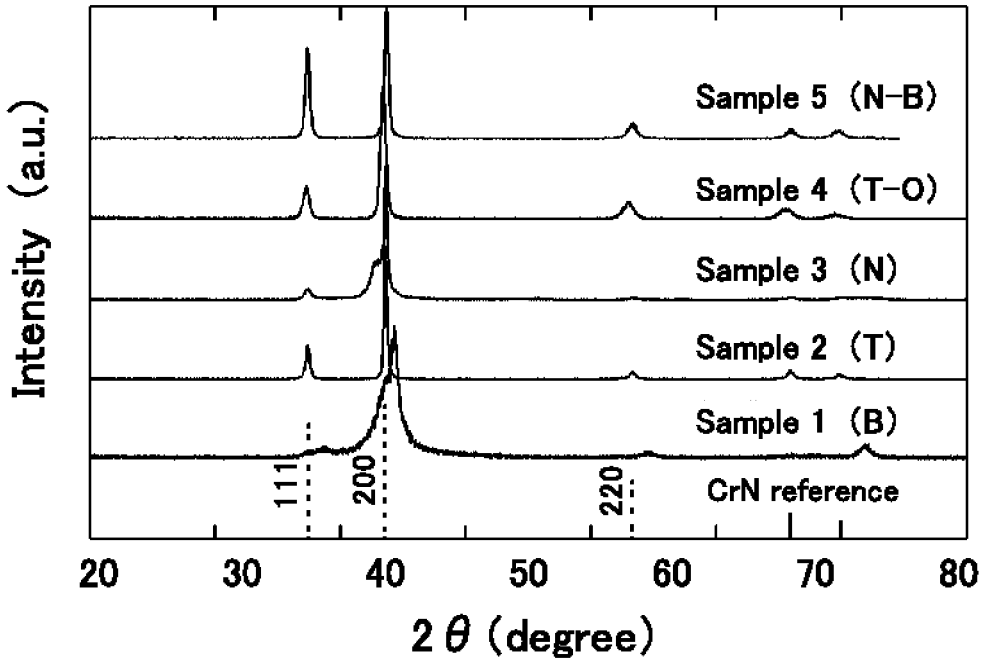
FIG. 1A is a set of profiles obtained using X-ray diffraction of chromium nitride films according to the samples.

One or more features freely selected from the description herein may be added to the above-described features of the present invention. The contents described herein may be applied not only to the sliding system as a whole according to the present invention but also to sliding members and lubricant oil which constitute the sliding system. Moreover, methodological features may also be features regarding a product. Which embodiment is the best or not is different in accordance with objectives, required performance and other factors.

<<Lubricant Oil>>

The lubricant oil according to the present invention is not limited in the type of a base oil and presence or absence of other additives, etc., as long as the lubricant oil contains a Mo-trinuclear. In general, lubricant oil such as engine oil contains various additives including S, P, Zn, Ca, Mg, Na, Ba, or Cu, etc. Even in such lubricant oil, the Mo-trinuclear according to the present invention preferentially acts on the sliding surface (coating surface) coated with the chromium nitride film and contributes to formation of a molybdenum sulfide compound (such as $MoS_2$, $Mo_3S_7$, $Mo_3S_8$ and $Mo_2S_6$) which can reduce the friction coefficient.

The lubricant oil according to the present invention may contain other Mo-based compounds (such as MoDTC) than the Mo-trinuclear, but the total amount of the contained Mo may preferably be small because Mo is a kind of rare metal.

Unduly small amount of the Mo-trinuclear makes it difficult to exhibit the effect as the above, whereas unduly large amount of the Mo-trinuclear may not cause any problem. As described above, however, the usage of Mo may preferably be small. It is therefore preferred that the Mo-trinuclear according to the present invention has a mass ratio of Mo to the lubricant oil as a whole of 5-800 ppm in an embodiment, 10-500 ppm in another embodiment, 40-200 ppm in still another embodiment, and 60-100 ppm in a further embodiment. When the mass ratio of Mo to the lubricant oil as a whole is represented in ppm, it will be denoted by "ppmMo." Note that, even when the lubricant oil contains other Mo-based compounds and the like than the Mo-trinuclear, the upper limit of the total amount of Mo of the other Mo-based compounds may preferably be 400 ppmMo in an embodiment, and 300 ppmMo in another embodiment, to the lubricant oil as a whole.

<<Chromium Nitride Film>>

Method of forming the chromium nitride film according to the present invention is not limited. For example, a desired chromium nitride film can be efficiently formed using a physical vapor deposition (PVD) method, such as an arc ion plating (AIP) method and a sputtering (SP) method (in particular, an unbalanced magnetron sputtering (UBMS) method).

The AIP method is a method in which a metal target (vaporization source) is used as the cathode to cause arc discharge in a reactive gas (process gas) so that metal ions generated from the metal target react with the reactive gas particles to form a dense film on a surface to be coated to which a bias voltage (negative voltage) is applied. In an embodiment of the present invention, the target may be metal Cr, and the reactive gas may be $N_2$ gas, for example. When forming a chromium nitride film that contains doped elements in addition to Cr and N, a target or a reactive gas that contains the doping elements may be used. The composition, structure and other properties of the chromium nitride film can be controlled by adjusting the components of the target and/or the reactive gas and/or adjusting the gas pressure of the reactive gas. For example, the gas pressure of $N_2$ may be adjusted thereby to allow a single-layer film of CrN or a composite film of CrN and $Cr_2N$ to be obtained.

The SP method is a method in which a voltage is applied between a target at the cathode side and a surface to be coated at the anode side, and inactive gas atom ions generated due to glow discharge are caused to collide with the target surface so that particles (atoms/molecules) released from the target are deposited to form a film on the surface to be coated. In an embodiment of the present invention, the sputtering is performed using metal Cr as the target and Ar gas as the inactive gas, for example, and the released Cr atoms (ions) can be reacted with $N_2$ gas thereby to form the chromium nitride film on a sliding surface.

<<Intended Use>>

The sliding members according to the present invention are not limited in the type, form, sliding form, and other features as long as the sliding members have sliding surfaces that relatively moves while the lubricant oil is interposed therebetween. The sliding system provided with such sliding members is also not limited in its specific form and intended use, and can be widely applied to various machines, apparatuses, and the like which require reduction of the sliding resistance and reduction of the machine loss due to sliding. For example, the sliding system of the present invention may preferably be utilized for a drive system unit (such as engine and transmission) for vehicles such as cars. Examples of the sliding members that constitute such a sliding system include: components, such as cam, valve lifter, follower, shim, valve and valve guide, which constitute a dynamic valve system; piston; piston ring; piston pin; crankshaft; gear; rotor; and rotor housing.

Examples

<<Overview>>

Materials under test coated with various chromium nitride films (sliding members) were combined with a lubricant oil containing a Mo-trinuclear (oil-soluble molybdenum compound) (referred to as a "lubricant oil A") or a lubricant oil free from a Mo-trinuclear (referred to as a "lubricant oil B) to perform a block-on-ring friction test. The present invention will be more specifically described with reference to the results of the friction test.

<<Production of Samples>>

(1) Base Material

A plurality of block-like base materials (6.3 mm×15.7 mm×10.1 mm) were prepared, each comprising a quenched steel material (JIS SUS440C). A surface (surface to be coated) of each base material was mirror-finished (surface roughness Ra: 0.08 micrometers).

A steel material (JIS SCM420) merely carburized was also prepared as a comparative sample not to be coated with a chromium nitride film (Sample C1 in Table 1). The carburized surface (hardness Hv of 700) was also mirror-finished to the same roughness.

(2) Film Formation of Chromium Nitride Films

Materials under test (Samples 1 to 5) were prepared by forming various chromium nitride films as listed in Table 1 on the surfaces of the above respective base materials. Formation of the chromium nitride films was performed using an arc ion plating (AIP) method or a sputtering (SP) method.

Formation of films using the arc ion plating method was performed by generating arc discharge on a target of metal Cr in $N_2$ gas (reactive gas) having an adjusted pressure of 0.3 to 6 Pa. Formation of an O-containing chromium nitride film was performed using a mixture gas of $N_2$ gas and $O_2$ gas as the reactive gas. During this operation, the ratio of the amount of O was 0.1 vol % to the mixture gas as a whole. Formation of a B-containing chromium nitride film was performed using a target of Cr—B alloy (Cr-5 mass % B).

Formation of a film using the sputtering method was performed by sputtering a target of metal Cr with Ar gas to cause the released Cr atoms (ions) to react with $N_2$ gas. During this operation, the pressure of the $N_2$ gas was 0.5 to 6 Pa.

(3) Comparative Samples

Another comparative sample was also prepared as a material under test (Sample C2) by coating the surface of the above-described base material (SUS440C) with a commercially available hydrogen-free DLC film (available from NIPPON ITF, INC.) as substitute for the chromium nitride film.

<<Measurement and Analysis of Chromium Nitride Films>>

(1) Film Composition and Film Properties

Film composition of each sample was quantified using an EPMA (JXA-8200 available from JEOL Ltd). Film hardness was measured using a nanoindenter tester (TRIBOSCOPE available from Hysitron Corporation). Film thickness was specified from a friction trace obtained using Calotest available from CSM Instruments SA. The film composition and the film properties thus obtained of each sample are also listed in Table 1. The surface profile (roughness) according to the present examples was measured using a white light interferometric non-contact surface profiler (NewView 5022 available from Zygo Corporation).

(2) Film Structure

Figure 1B:
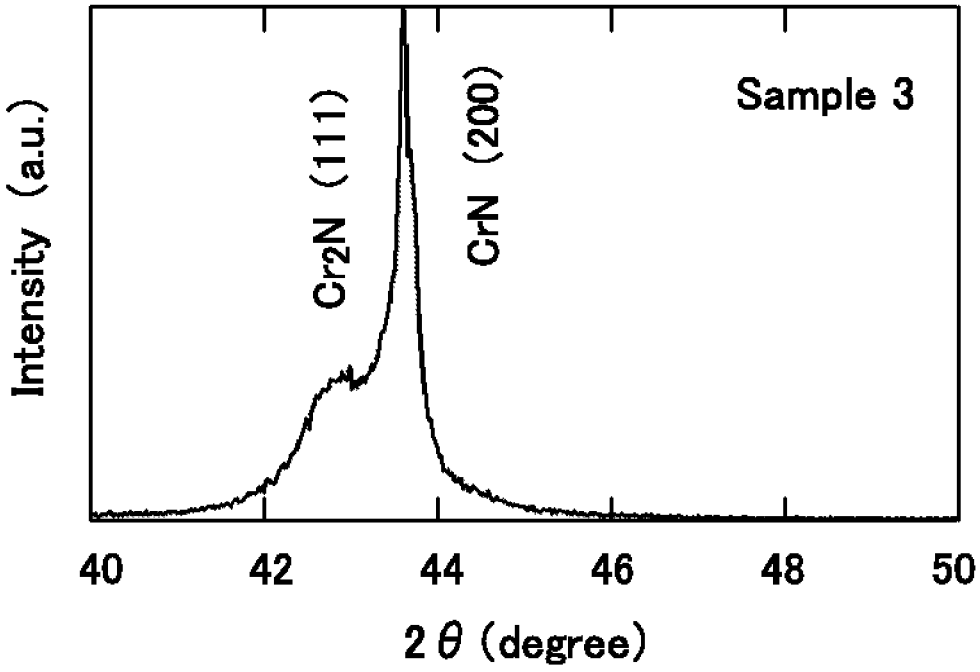
FIG. 1B is an enlarged view of the X-ray diffraction profile according to Sample 3.

The chromium nitride film of each sample was analyzed using X-ray diffraction. Respective profiles thus obtained are shown in FIG. 1A in a superimposed manner. As one example among them, the profile according to Sample 3 is shown in FIG. 1B in an enlarged manner. FIG. 1A and FIG. 1B may be collectively referred to as FIG. 1.

The relative surface area of (111) plane to (200) plane was obtained according to the previously-described method on the basis of each profile shown in FIG. 1. The relative surface area thus calculated of each sample is also listed in Table 1. As found from the profiles of the samples, Cr was not detected in all of the samples, and CrN was primarily detected. Note, however, that $Cr_2N$ was detected in addition to CrN only in Sample 3. Presence or absence of detection of $Cr_2N$ is also listed in Table 1.

<<Lubricant Oil>>

Two types of engine oils listed in Table 3 were prepared as lubricant oils to be used in the friction test. Lubricant oil A was obtained by additionally compounding Mo trinuclear denoted as "Trinuclear" in the disclosed documentation "Molybdenum Additive Technology for Engine Oil Applications" available from INFINEUM INTERNATIONAL LIMITED (which may be referred simply to as "Mo-trinuclear") to an engine oil as a base (motor oil SN OW-20 available from TOYOTA MOTOR CORPORATION) having a viscosity grade of OW-20 and corresponding to ILSAC GF-5 standard so that the Mo content in the oil as a whole would be 80 ppmMo equivalent. On the other hand, lubricant oil B is the base engine oil itself to which such an oil additive is not additionally compounded. Both lubricant oils are free from molybdenum dithiocarbamate (MoDTC).

<<Block-on-Ring Friction Test>>

(1) Friction Coefficient

Figure 2:
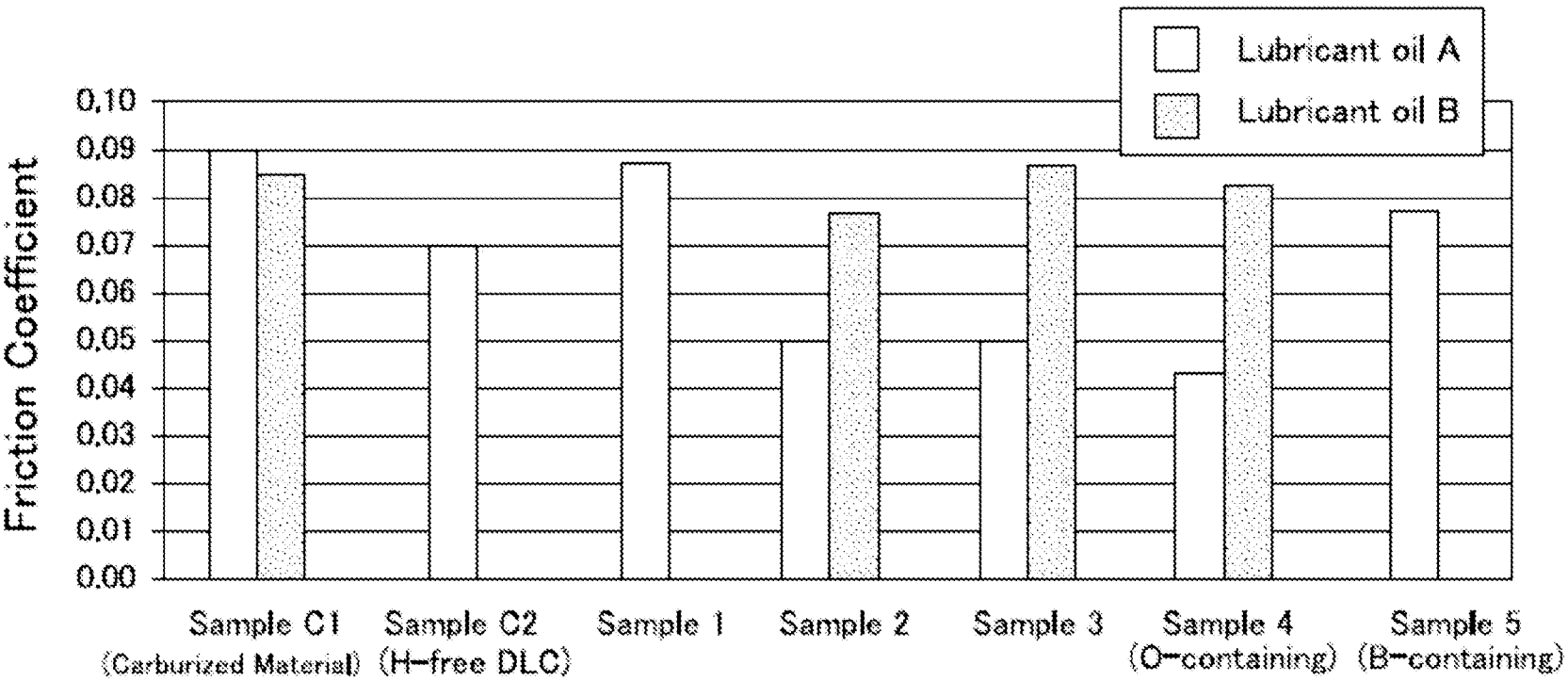
FIG. 2 is a bar graph comparing friction coefficients of the samples.

Block-on-ring friction test (referred simply to as "friction test") was performed for a combination of each material under test and each lubricant oil to measure the friction coefficient (mu) of each sliding surface. The friction coefficient of each material under test when using the lubricant oil A containing the Mo-trinuclear is also listed in Table 1. A bar graph comparing these friction coefficients is shown in FIG. 2.

The friction test was performed using each material under test as a block test piece having a sliding surface width of 6.3 mm and using a standard test piece S-10 (hardness HV of 800 and surface roughness Rzjis of 1.7 to 2.0 micrometers) of a carburized steel material (AISI4620) available from FALEX CORPORATION as a ring test piece (outer diameter of 35 mm and width of 8.8 mm). The friction test was performed for 30 minutes under the conditions of a test load of 133 N (Hertz contact pressure of 210 MPa), a sliding speed of 0.3 m/s, and an oil temperature of 80 degrees C. (fixed), and the average value of mu during one minute immediately before completion of the test was determined as the friction coefficient.

(2) Friction Depth of Sliding Surface

Figure 3:
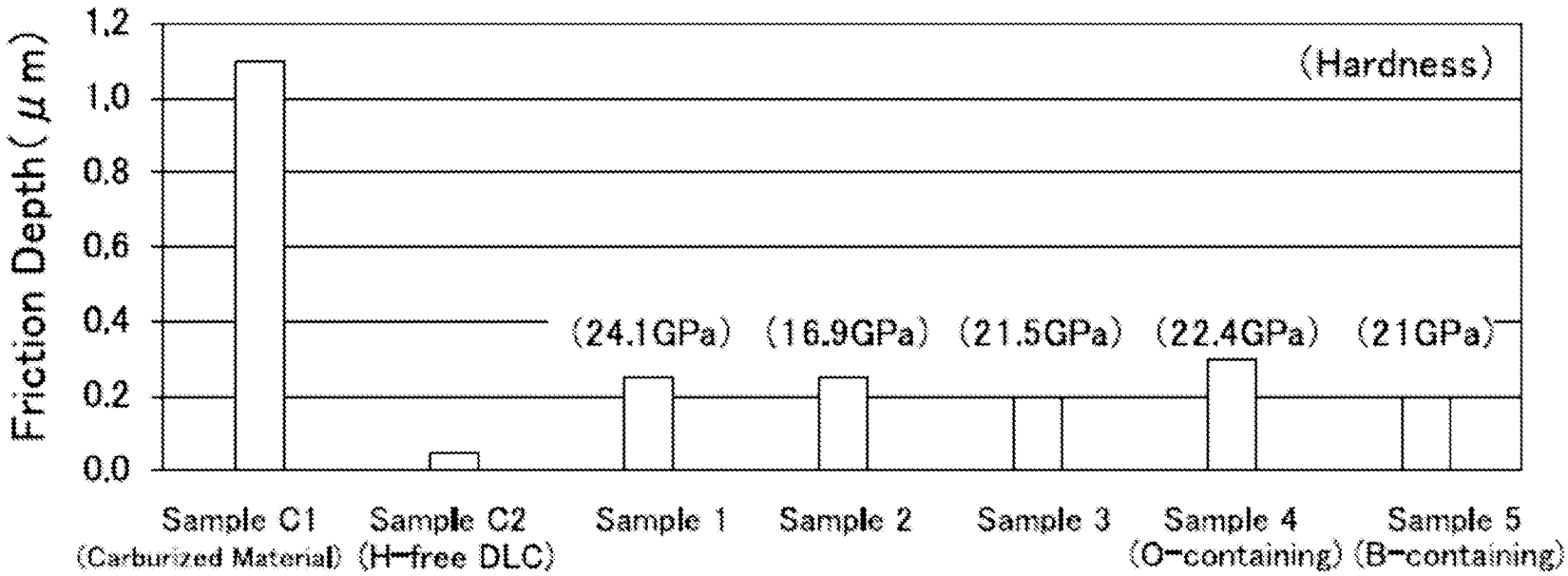
FIG. 3 is a bar graph comparing friction depths of the samples.

The sliding surface of each material under test after the friction test using the lubricant oil A was measured using the previously-described non-contact surface profiler to obtain a friction depth. Results thereof are also listed in Table 1. In addition, a bar graph comparing the friction coefficients is shown in FIG. 3 with indication of corresponding film hardness.

(3) Surface Analysis of Sliding Surface

Figure 5:
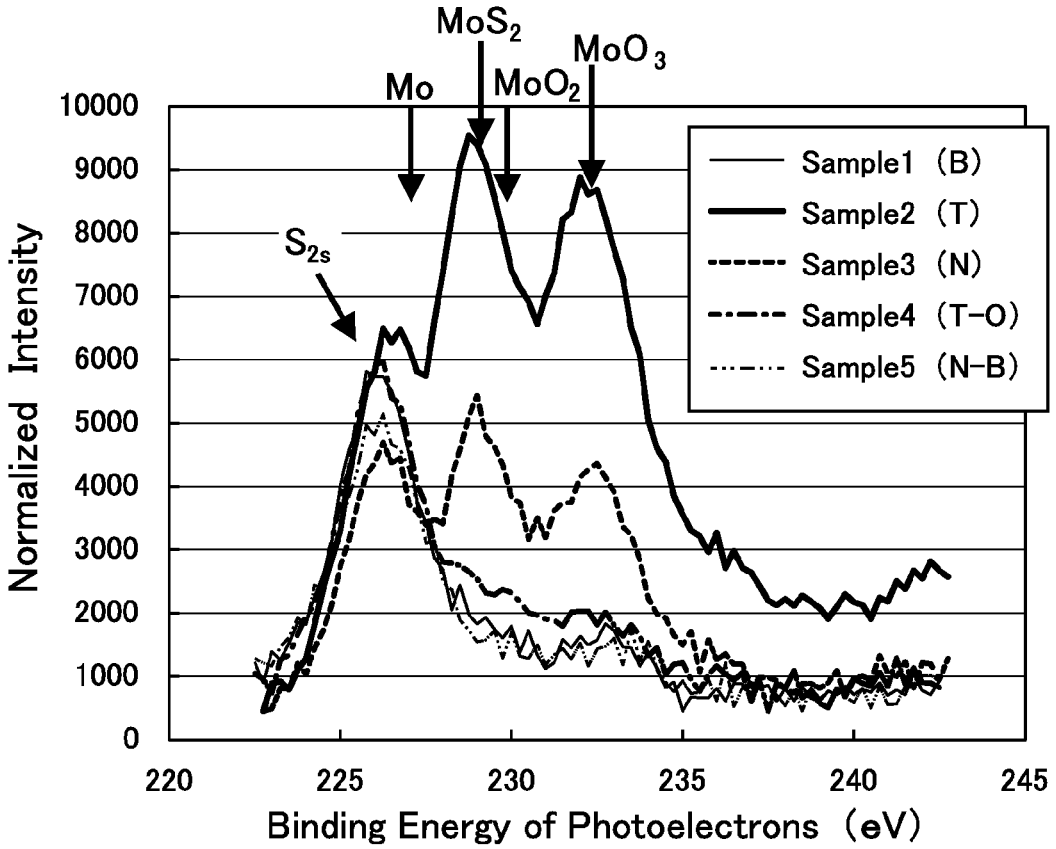
FIG. 5 is a set of 3d spectra of Mo obtained using XPS to analyze a sliding surface of each sample after friction test.
Figure 6:
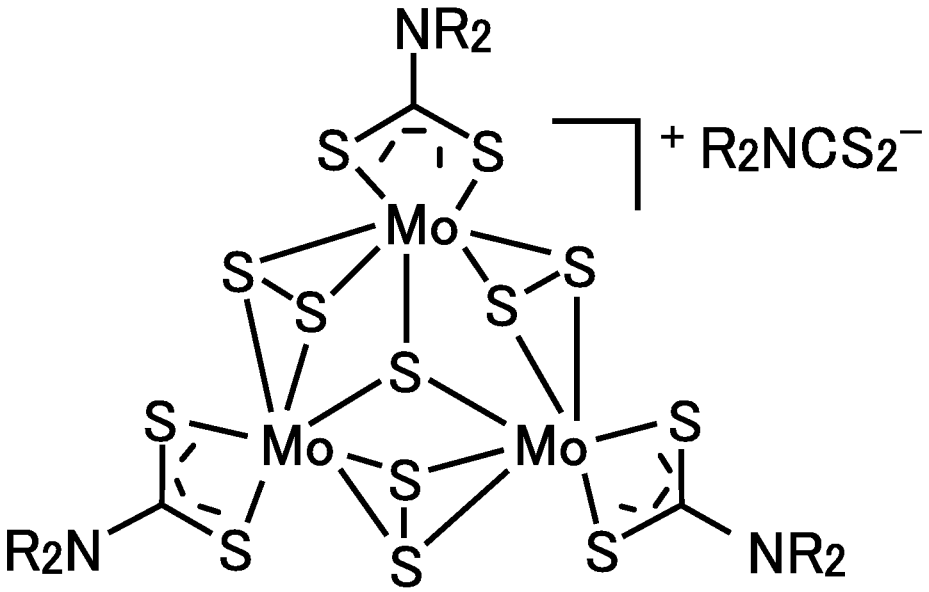
FIG. 6 is a molecular structure diagram showing an example of Mo-trinuclear according to the present invention.

The sliding surface of each material under test after the friction test using the lubricant oil A was analyzed using X-ray photoelectron spectroscopy (XPS). The ratio (at %) of an element detected on each sliding surface is listed in Table 2. In addition, results of state analysis using 3d spectra of Mo are shown in FIG. 5. As will be understood, the presence of oxide or sulfide of Mo can be determined by observing the 3d spectra of Mo.

<<Evaluation>>

(1) Friction Property

First, as apparent from FIG. 2, when the lubricant oil B free from Mo-trinuclear was used, the friction coefficient was not much different among the samples provided with the chromium nitride films on the sliding surfaces, the sample provided with the H-free DLC film on the sliding surface, and the sample with the sliding surface of the carburized material itself. The friction coefficient was higher than 0.07 in all of the samples.

It was found on the other hand that, when the lubricant oil A containing the Mo-trinuclear was used, the friction coefficient was drastically reduced only in Samples 2 to 4 provided with specific chromium nitride films on the sliding surfaces. Specifically, it was found that the friction coefficient was 0.05 or lower in all of Samples 2 to 4 and reduced by 40% or more to the friction coefficient (0.09) of Sample C1 with the sliding surface of the carburized material itself.

Next, as apparent from FIG. 3, it was also confirmed that the friction depth was small, i.e., about 0.2 micrometers, in all of Samples 1 to 5 provided with the chromium nitride films and did not come to that of Sample C2 provided with the DLC film, but Samples 1 to 5 exhibited sufficient wear resistance compared with the friction depth (1 micrometer or more) of Sample C1. The chromium nitride film formed by the SP method and having the smallest amount of N was hardest, but the hardness was stable within 15 to 25 GPa in all of the chromium nitride films. It can thus be considered that special correlationship does not exist between the film hardness and the composition (e.g., N amount) or the production method, etc.

(2) Structure of Chromium Nitride Films

As described above, the chromium nitride films of Samples 2 to 4 are apparently different from those of Samples 1 and 5 in the sliding properties under the situation where the lubricant oil A is present. This appears to be because the film structure differs between Samples 2 to 4 and Samples 1 and 5. That is, the chromium nitride films of Samples 1 to 5 are primarily formed of CrN, but the relative surface area of (111) plane to (200) plane is significantly different between Samples 2 to 4 and Samples 1 and 5, as understood from FIG. 1 and Table 1.

Figure 4:
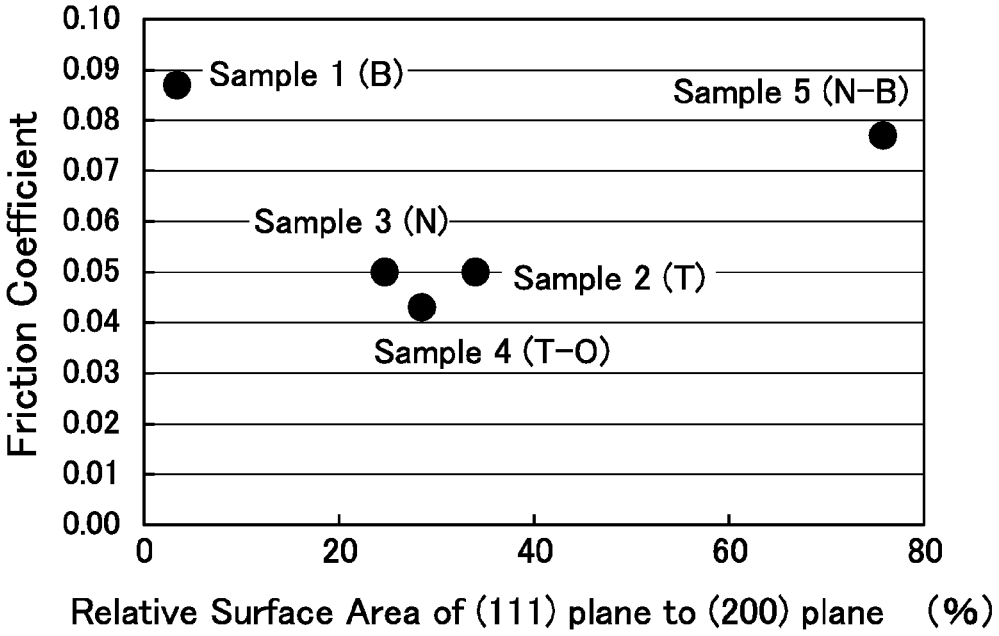
FIG. 4 is a dispersion diagram showing a correlation between relative surface areas and friction coefficients of the samples.

To clarify this aspect, FIG. 4 will now be referred which shows a relationship between the relative surface area and the friction coefficient in the presence of the lubricant oil A. As apparent from FIG. 4, it has been found that the friction coefficient is large in both of the chromium nitride film (Sample 1) having an unduly small relative surface area and strong orientation of (200) plane and the chromium nitride film (Sample 5) having an unduly large relative surface area and strong orientation of (111) plane. It has been found on the other hand that the friction coefficient is 0.05 or less in the chromium nitride films (Samples 2 to 4) having a relative surface area of 15-60% in an embodiment, and 20-45% in another embodiment in which (200) plane and (111) plane are mixed at an appropriate ratio, and these samples exhibit excellent low-friction properties.

(3) Surface Analysis of Sliding Surfaces

As found from Table 2, Mo was detected on the sliding surfaces of Samples 2 to 4 which exhibited low-friction properties in the presence of the lubricant oil A, whereas Mo was not detected on the sliding surfaces of Samples 1 and 5 which did not exhibit low-friction properties. Moreover, as apparent from FIG. 5, it was found that sulfide or oxide of Mo was generated on the sliding surfaces of Samples 2 to 4, whereas such a generated product was not confirmed on the sliding surfaces of Samples 1 and 5. Furthermore, it was also found that a larger amount of Mo sulfide ($MoS_2$) than that of Mo oxide was detected on the sliding surfaces of Samples 2 and 3. In addition, as apparent from Table 2, an amount of S twice or more (or four times or more) that of Mo was detected in all of the samples in which 0.04 at % or more of Mo was detected.

(4) Consideration

In the light of the above results, it can be considered that a chromium nitride film having a specific structure in which (200) plane and (111) plane are mixed within a certain range is formed with a molybdenum sulfide compound, such as $Mo_3S_7$, $Mo_3S_8$ and $MoS_2$, on the surface (sliding surface) due to adsorption or reaction of Mo-trinuclear in a situation where a lubricant oil that contains Mo-trinuclear is present. It can also be considered that the molybdenum sulfide having such a lamellar structure exhibits a low shear property, and the sliding surface of the chromium nitride film according to the present invention can thereby exhibit excellent low-friction property.

TABLE 1

| Sample | | Production | Film Composition (at %) | | | | Film Properties | | Film Structure (X-ray diffraction) | | Sliding Properties | | | |
|---|---|---|---|---|---|---|---|---|---|---|---|---|---|---|
| | | | | | | | | | | | Friction Coefficient | | Friction Depth (μm) | |
| No. | Name | Method | Cr | N | O | B | Film Hardness (GPa) | Film Thickness (μm) | Relative Surface Area (111)/(200) (%) | Presence or Absence of $Cr_2N$ | Lubricant Oil A | Lubricant Oil B | Lubricant Oil A | Note |
| 1 | B | SP Method | 62.4 | 37.6 | — | — | 24.1 | 2 | 3.4 | Absent | 0.087 | — | 0.25 | |
| 2 | T | AIP Method | 50.7 | 49.3 | — | — | 16.9 | 13 | 34 | Absent | 0.05 | 0.077 | 0.25 | |
| 3 | N | | 60.9 | 39.1 | — | — | 21.5 | 8 | 24.7 | Present | 0.05 | 0.087 | 0.2 | |
| 4 | T-O | | 49.8 | 40.5 | 9.8 | — | 22.4 | 13 | 28.5 | Absent | 0.043 | 0.083 | 0.3 | |
| 5 | N-B | | 48.7 | 50.0 | — | 1.3 | 21.0 | 9 | 75.8 | Absent | 0.077 | — | 0.2 | |
| C1 | (Carburized Material) | — | | — | | | (HV700) | — | | — | 0.09 | 0.085 | 1.1 | SCM420 |
| C2 | (DLC) | | | — | | | 59.0 | | | — | 0.07 | 0.075 | 0.05 | H-free DLC |

TABLE 2

| Sample | | Analyzed Composition on Sliding Surface (at %) | | | | | | | | | | |
|---|---|---|---|---|---|---|---|---|---|---|---|---|
| No. | Name | C | N | O | Na | P | S | Ca | Fe | Cr | Zn | Mo |
| 1 | B | 32.8 | 6.14 | 33.4 | 0.00 | 7.27 | 1.89 | 4.14 | 0.45 | 9.60 | 4.25 | 0.00 |
| 2 | T | 37.0 | 2.61 | 36.4 | 0.00 | 6.52 | 2.61 | 8.45 | 0.60 | 2.41 | 2.87 | 0.55 |
| 3 | N | 30.2 | 5.15 | 36.1 | 0.00 | 7.77 | 2.08 | 4.91 | 0.71 | 8.47 | 4.57 | 0.08 |
| 4 | T-O | 32.2 | 3.35 | 37.8 | 0.00 | 7.58 | 1.89 | 7.77 | 0.65 | 4.89 | 3.58 | 0.25 |
| 5 | N-B | 31.9 | 7.41 | 33.6 | 0.00 | 7.06 | 1.99 | 4.30 | 0.62 | 8.50 | 4.60 | 0.00 |

TABLE 3

| | Presence or Absence of Mo Trinuclear | Components of Lubricant Oil (The Balance: Base Oil) (ppm) | | | | | | | | |
|---|---|---|---|---|---|---|---|---|---|---|
| Name of Lubricant Oil | Compound | Mo | S | Zn | P | N | B | Ca | Na | Si |
| Lubricant Oil A | Present (80 ppm) | 80 | 2400 | 700 | 630 | 500 | 16 | 2000 | 0 | 4 |
| Lubricant Oil B | Absent | 130 | 1800 | 730 | 690 | 900 | 4 | 1760 | 360 | 4 |

The invention claimed is:

1. A sliding system comprising:

a pair of sliding members having sliding surfaces that can relatively move while facing each other; and a lubricant oil that can be interposed between the sliding surfaces facing each other, wherein at least one of the sliding surfaces comprises a coating surface of a chromium nitride film;

wherein the lubricant oil contains an oil-soluble molybdenum compound that has a chemical structure of a trinuclear molybdenum compound, wherein, when the chromium nitride film as a whole is 100 at % (referred simply to as "%"), the chromium nitride film contains 40-65% of Cr and 35-55% of N, and the chromium nitride film has a relative surface area of 15-34% wherein the relative surface area is a surface area ratio of (111) plane to (200) plane obtained when analyzed using X-ray diffraction.

2. The sliding system as recited in claim 1, wherein Mo and S are present on the sliding surface of the chromium nitride film, and a ratio of a number of atoms of S to that of Mo is 2 or more when analyzed using X-ray photoelectron spectroscopy (XPS).

3. The sliding system as recited in claim 1, wherein the chromium nitride film further contains 2-15% of O.

4. The sliding system as recited in claim 1, wherein the chromium nitride film contains $Cr_2N$ in addition to CrN.

5. The sliding system as recited in claim 1, wherein the trinuclear molybdenum compound has a molecular structural skeleton of at least one of $Mo_3S_7$ or $Mo_3S_8$.

6. The sliding system as recited in claim 1, wherein the lubricant oil contains the oil-soluble molybdenum compound with a mass ratio of Mo to the lubricant oil as a whole of 5-800 ppm.

7. The sliding system as recited in claim 1, wherein, when a detected amount by the XPS is 100 at % as a whole, 0.04 at % or more of Mo is present.

8. The sliding system as recited in claim 1, wherein, when a detected amount by the XPS is 100 at % as a whole, 0.06 at % or more of Mo is present.

9. The sliding system as recited in claim 8, wherein Mo and S are present on the sliding surface of the chromium nitride film, and a ratio of number of atoms of S to that of Mo is 2 or more when analyzed using X-ray photoelectron spectroscopy (XPS).

10. The sliding system as recited in claim 1, wherein the ratio of number of atoms of S to that of Mo is 4 or more when analyzed using X-ray photoelectron spectroscopy (XPS).

11. The sliding system as recited in claim 1, wherein the ratio of number of atoms of S to that of Mo is 5 or more when analyzed using X-ray photoelectron spectroscopy (XPS).

* * * * *